US011019860B1

(12) United States Patent
Pierce

(10) Patent No.: US 11,019,860 B1
(45) Date of Patent: Jun. 1, 2021

(54) HOSPITAL GOWN

(71) Applicant: Wendy Dale Pierce, Tampa, FL (US)

(72) Inventor: Wendy Dale Pierce, Tampa, FL (US)

( * ) Notice: Subject to any disclaimer, the term of this patent is extended or adjusted under 35 U.S.C. 154(b) by 0 days.

(21) Appl. No.: 15/418,430

(22) Filed: Jan. 27, 2017

Related U.S. Application Data

(60) Provisional application No. 62/289,002, filed on Jan. 29, 2016.

(51) Int. Cl.
*A41D 13/12* (2006.01)

(52) U.S. Cl.
CPC ..... *A41D 13/1236* (2013.01); *A41D 13/12* (2013.01); *A41D 13/129* (2013.01); *A41D 13/1245* (2013.01); *A41D 13/1254* (2013.01); *A41D 13/1263* (2013.01); *A41D 13/1281* (2013.01)

(58) Field of Classification Search
CPC ..... A41D 13/1236; A41D 13/12; A41D 13/1263; A41D 13/1254; A41D 13/129; A41D 13/1281; A41D 13/1245
See application file for complete search history.

(56) References Cited

U.S. PATENT DOCUMENTS 1,489,046 A * 4/1924 Thompson ..... A41B 9/08 2/114
3,144,661 A * 8/1964 Buser ..... A61G 10/04 2/114
4,004,294 A * 1/1977 Pinch ..... A41D 1/215 2/104
4,106,120 A * 8/1978 Zurbrigg ..... A41D 13/1209 2/51
4,622,699 A * 11/1986 Spriggs ..... A41D 13/1236 2/114
4,663,782 A * 5/1987 Knox ..... A41D 1/215 2/104
4,805,241 A * 2/1989 Faccini ..... A41D 13/1236 2/102
5,050,242 A * 9/1991 Udell ..... A41D 13/1236 2/114
5,050,243 A * 9/1991 Udell ..... A41D 13/1236 2/114
5,440,763 A * 8/1995 Shah ..... A41D 13/1236 2/105
5,749,365 A * 5/1998 Magill ..... A61B 5/0008 128/903
6,134,715 A * 10/2000 McLennan ..... A41D 13/1245 2/105
6,647,552 B1 * 11/2003 Hogan ..... A41D 13/1245 2/114
7,181,773 B1 * 2/2007 Piraka ..... A41D 13/1281 2/114

(Continued)

*Primary Examiner* — Khaled Annis
(74) *Attorney, Agent, or Firm* — Akerman LLP; Peter A. Chiabotti

(57) ABSTRACT

A gown is formed with a front, a back, a left side, a right side, a left lateral arm opening, and a right lateral arm opening. A plurality of flaps are each formed in an inverted U-shaped configuration with a lower horizontal section coupled to the gown. The gown has a openings positioned beneath the flaps. Fixed hook and loop fasteners around each of the openings and separable hook and loop fasteners on each flap are adapted to couple and uncouple. The flaps are adapted to be lowered to provide for use by a care giver when administering to a patient.

10 Claims, 3 Drawing Sheets

(56) References Cited

U.S. PATENT DOCUMENTS

| | | | | |
|---|---|---|---|---|
| 8,690,835 | B1 * | 4/2014 | Parris | A41D 13/1236 2/104 |
| 8,776,264 | B2 * | 7/2014 | Kiernan | A41D 1/002 2/69 |
| 2007/0157362 | A1 * | 7/2007 | Rogers | A41D 13/1236 2/114 |
| 2007/0245450 | A1 * | 10/2007 | Feodoroff | A41D 13/1245 2/114 |
| 2008/0000006 | A1 * | 1/2008 | Ochoa | A41D 13/1236 2/114 |
| 2010/0242150 | A1 * | 9/2010 | Trouillot | A41D 13/1245 2/114 |
| 2012/0151658 | A1 * | 6/2012 | Von Furstenberg | A41D 13/1236 2/114 |
| 2013/0036526 | A1 * | 2/2013 | Rashman | A41D 13/1245 2/114 |
| 2013/0104281 | A1 * | 5/2013 | Mattick | A41D 13/1236 2/114 |
| 2013/0131617 | A1 * | 5/2013 | Kovensky | A41D 13/1281 604/327 |
| 2015/0157069 | A1 * | 6/2015 | Hieber | A41D 13/1245 2/114 |
| 2015/0374048 | A1 * | 12/2015 | Theodossiou | A41D 13/1245 2/114 |

* cited by examiner

HOSPITAL GOWN

RELATED APPLICATION

The present non-provisional patent application is based upon Provisional Application No. 62/289,002 filed Jan. 29, 2016, the subject matter of which is incorporated herein by reference and the priority of which is hereby claimed.

BACKGROUND OF THE INVENTION

Field of the Invention

The present invention relates to a hospital gown system and more particularly pertains to maintaining privacy of a patient at all times while allowing access by a health care provider to various body parts of the patient. The maintaining privacy and allowing access is done in a safe, professional, modest, and economical manner.

Description of the Prior Art

The use of hospital gowns of known designs and configurations is known in the prior art. More specifically, hospital gowns of known designs and configurations previously devised and utilized for the purpose of maintaining a patient's privacy and allowing access by health care providers are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a hospital gown that allows maintaining privacy of a patient at all times while allowing access by a health care provider to various body parts of the patient. The maintaining privacy and allowing access is done in a safe, professional, modest, and economical manner.

In this respect, the hospital gown according to the present invention substantially departs from the conventional concepts and designs of the prior art, and in doing so provides an apparatus primarily developed for the purpose of maintaining privacy of a patient at all times while allowing access by a health care provider to various body parts of the patient. The maintaining privacy and allowing access is done in a safe, professional, modest, and economical manner.

Therefore, it can be appreciated that there exists a continuing need for a new and improved hospital gown which can be used for maintaining privacy of a patient at all times while allowing access by a health care provider to various body parts of the patient. The maintaining privacy and allowing access is done in a safe, professional, modest, and economical manner. In this regard, the present invention substantially fulfills this need.

SUMMARY OF THE INVENTION

In view of the foregoing disadvantages inherent in the known types of hospital gowns of known designs and configurations now present in the prior art, the present invention provides an improved hospital gown. As such, the general purpose of the present invention, which will be described subsequently in greater detail, is to provide a new and improved hospital gown and method which has all the advantages of the prior art and none of the disadvantages.

To attain this, the present invention from a broad perspective essentially comprises a garment. First provided is a gown formed with a front, a back, a left side, a right side, a left lateral arm opening, and a right lateral arm opening. Next a plurality of flaps are provided. Each flap is formed in an inverted U-shaped configuration with a lower horizontal section coupled to the gown. The gown has a plurality of openings. Each of the openings is positioned beneath one of the flaps. Fixed hook and loop fasteners are around each of the openings. Separable hook and loop fasteners on each flap are adapted to couple and uncouple with respect to associated fixed hook and loop fasteners. The flaps are adapted to be lowered to provide for use by a care giver when administering to a patient.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hospital gown system which has all of the advantages of the prior art hospital gowns of known designs and configurations and none of the disadvantages.

It is another object of the present invention to provide a new and improved hospital gown which may be easily and efficiently manufactured and marketed.

It is further object of the present invention to provide a new and improved hospital gown which is of durable and reliable constructions.

An even further object of the present invention is to provide a new and improved hospital gown which is susceptible of a low cost of manufacture with regard to both materials and labor, and which accordingly is then susceptible of low prices of sale to the consuming public, thereby making such hospital gown economically available to the buying public.

Lastly, it is an object of the present invention to provide a hospital gown for maintaining privacy of a patient at all times while allowing access by a health care provider to various body parts of the patient. The maintaining privacy and allowing access is done in a safe, professional, modest, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
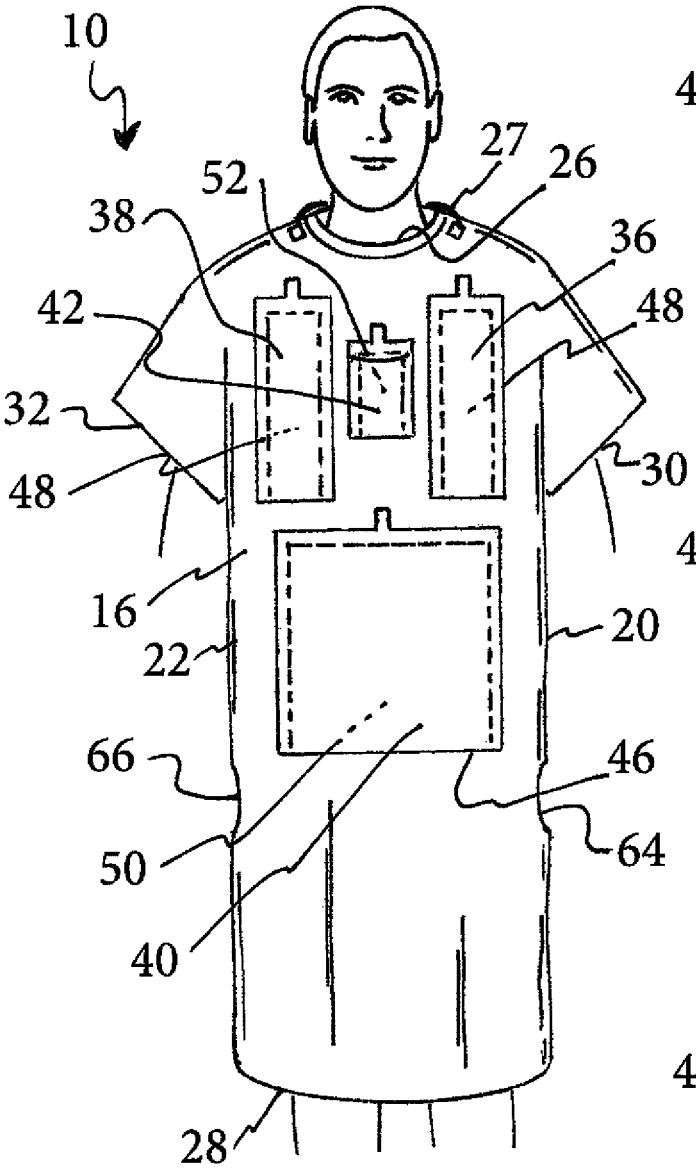
FIG. 1 is a front elevational view of a hospital gown constructed in accordance with the principles of the present invention.
Figure 2:
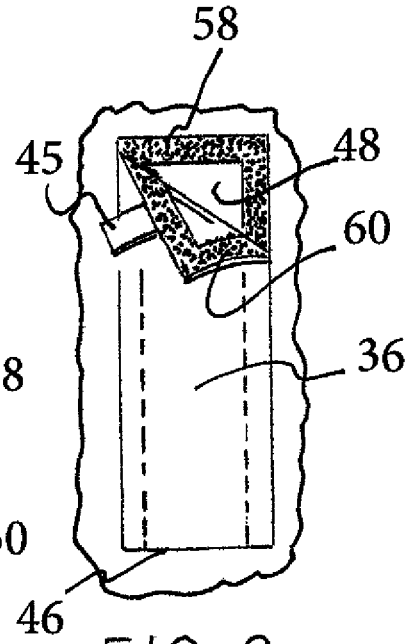
FIG. 2 is an enlarged showing of the left mid-chest flap, the flap being partially open.
Figure 3:
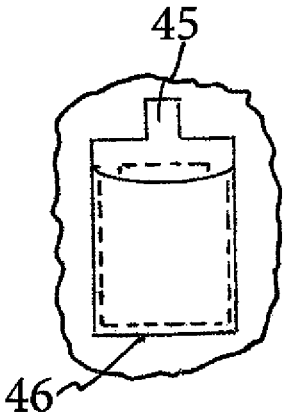
FIG. 3 is an enlarged showing of the central mid-chest pocket, the flap being partially open.
Figure 4:
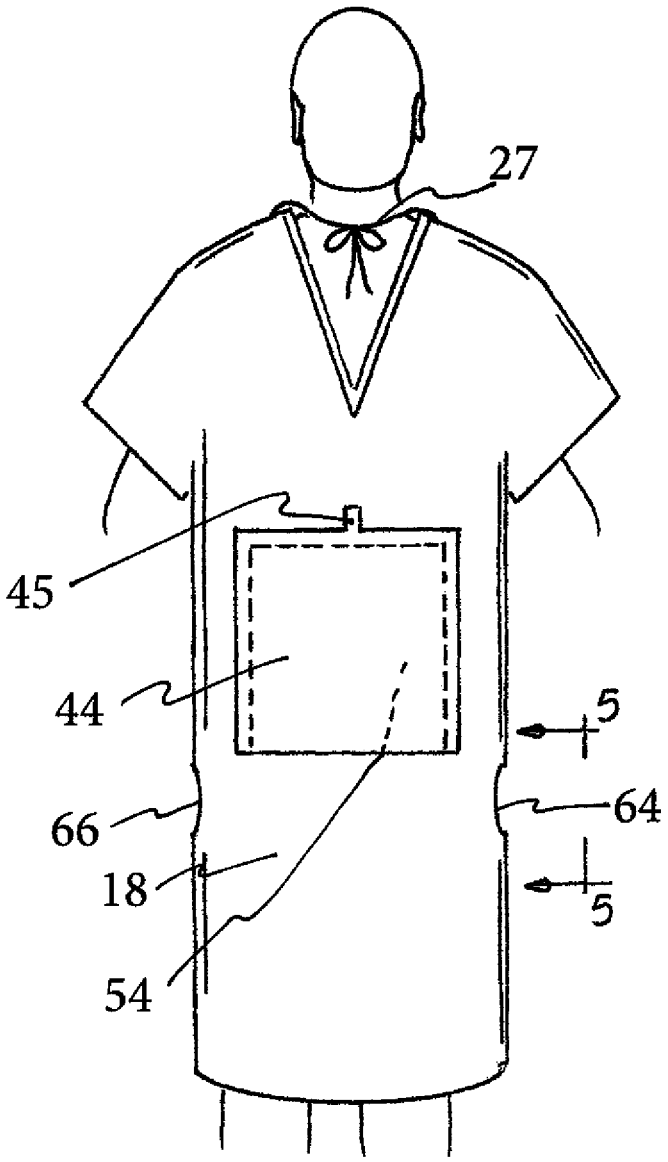
FIG. 4 is a rear elevational view of the hospital gown shown in FIG. 1.
Figure 5:
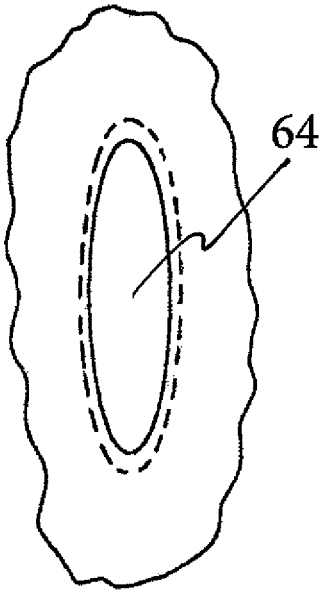
FIG. 5 is a side elevational view of the left side opening taken along line 5-5 of FIG. 4.

With reference now to the drawings, and in particular to FIG. 1 thereof, the preferred embodiment of the new and improved hospital gown embodying the principles and concepts of the present invention and generally designated by the reference numeral 10 will be described.

The present invention, the hospital gown 10 is comprised of a plurality of components. Such components in their broadest context include a gown and a plurality of flaps. Such components are individually configured and correlated with respect to each other so as to attain the desired objective.

From a specific standpoint, the present invention is a garment 10 for maintaining privacy of a patient at all times while allowing access by a health care provider to various body parts of the patient. In the preferred embodiment, first provided is a hospital gown 14. The gown is formed with a front 16, a back 18, a left side 20, and a right side 22. The gown is of a one piece construction with a head opening 26 above, a leg opening 28 below, a left lateral arm opening and sleeve 30, and a right lateral arm opening and sleeve 32. Cords 27 are provided at the back of the head opening to secure the garment in position while being worn. In the preferred embodiment, the gown is a pull over garment.

Next provided are a left mid-chest flap 36 and a right mid-chest flap 38. Also provided are an enlarged abdominal flap 40 located below the left mid-chest flap and the right mid-chest flap. Next provided is a central pocket flap 42 between the left mid-chest flap and the right mid-chest flap. Next, a rear pocket flap 44 is provided. A tab 45 extends upwardly on each flap to facilitate opening and closing the flaps. Each flap is formed in an inverted U-shaped configuration with a lower horizontal section 46 coupled to the gown. The gown has openings 48, 50, 52, 54 positioned respectively beneath the left mid-chest flap and the right mid-chest flap, and the abdominal flap, and the central pocket flap, and the rear pocket flap respectively. The central pocket flap and the rear pocket flap are adapted to removably receive telemetry and other devices in association with providing medical care to the patient. Fixed hook and loop fasteners 58 in an inverted U-shaped configuration are provided around each opening. Separable hook and loop fasteners 60 in an inverted U-shaped configuration are provided around each flap and are adapted to couple and uncouple with respect to an associated fixed hook and loop fastener. The flaps are adapted to be lowered providing for use by the care giver when administering to the patient.

Lastly, a left passageway 64 is provided on the left side of the gown and a right passageway 66 is provided on the right side of the gown. Each passageway is located beneath the abdominal flap for use by the care giver when administering to the patient.

Figure 6:
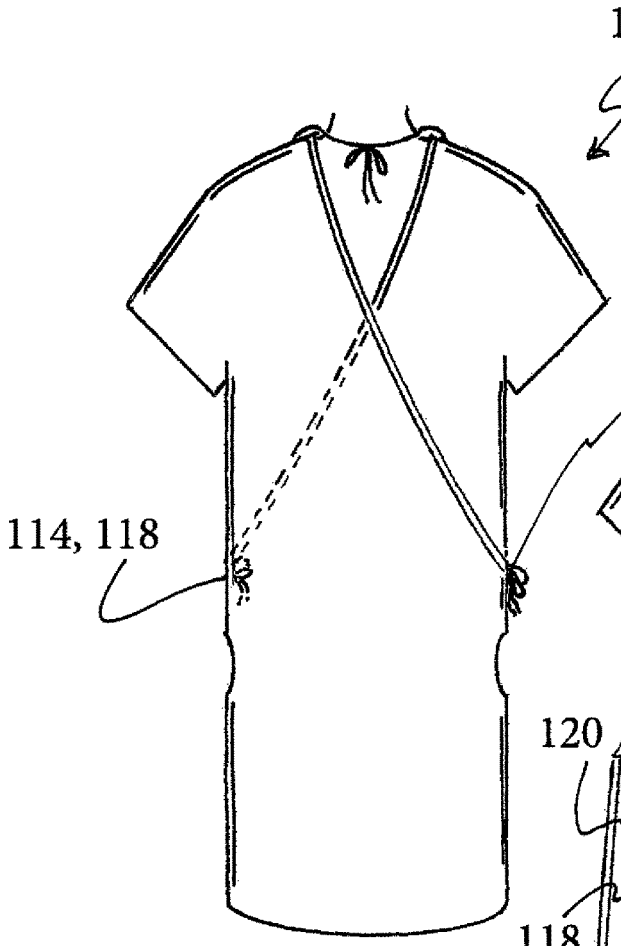
FIG. 6 is a rear elevational view of a hospital gown constructed in accordance with an alternate embodiment of the invention.
Figure 7:
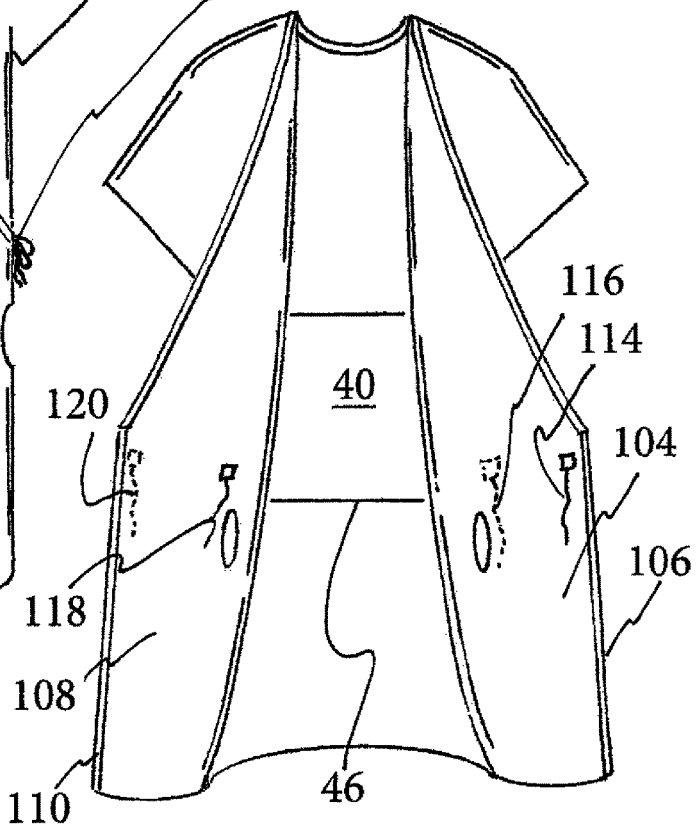
FIG. 7 is a rear elevational view of the hospital gown illustrated in FIG. 6 but with the back open.

An alternate embodiment of the garment 100 is shown in FIGS. 6 and 7. In this embodiment, the back of the gown is an open wrap-around back formed of a left rear region 104 with a left edge 106 and a right rear region 108 with a right edge 110. A left interior string 114 and a left exterior string 116 are provided. Also provided are a right interior string 118 and a right exterior string 120. An aperture extends through the gown above each string. Each string is adapted to be fed through an associated one of the apertures to tie the gown in a closed orientation when worn by the patient.

In another embodiment, the left mid-chest flap, the right mid-chest flap, the enlarged abdominal flap located below the left mid-chest flap and the right mid-chest flap, and the central pocket flap located between the left mid-chest flap and the right mid-chest flap are provided. In this embodiment the rear pocket flap is not included.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garment comprising:

a gown formed with a front and a back and a left side and a right side and a left lateral arm opening and a right lateral arm opening;

a plurality of flaps, each flap formed in an inverted U-shaped configuration with a lower horizontal section coupled to the gown, the gown having a plurality of openings positioned respectively beneath the flaps, fixed hook and loop fasteners around each of the openings, separable hook and loop fasteners on each flap, each flap adapted to couple and uncouple with respect to an associated fixed hook and loop fastener, the flaps adapted to be lowered providing for use by a care giver, wherein one of the plurality of flaps comprises an abdominal flap; and a left passageway on the left side of the gown and a right passageway on the right side of the gown, each passageway being located beneath the abdominal flap for use by the care giver.

2. The garment as set forth in claim 1, a pocket coupled to at least one of the plurality of flaps.

3. The garment as set forth in claim 1, wherein the garment is a pull over garment.

4. The garment as set forth in claim 1, wherein the back of the gown is an open wrap-around back formed of a left rear region with a left edge and a right rear region with a right edge, a left interior string and a left exterior string, a right interior string and a right exterior string.

5. The system as set forth in claim 1, wherein the plurality of flaps include a left mid-chest flap, and a right mid-chest flap, and an enlarged abdominal flap located below the left mid-chest flap and the right mid-chest flap, and a central pocket flap located between the left mid-chest flap and the right mid-chest flap.

6. A garment for maintaining privacy at all times of a patient in a hospital while allowing access by a health care provider to various body parts of the patient comprising, in combination:

a gown formed with a front, and a back, and a left side, and a right side, the gown being of a one piece construction with a head opening above, cords at a back of the head opening to secure the garment in position, and a leg opening below, and a left lateral arm opening and sleeve, and a right lateral arm opening and sleeve, the gown being a pull over garment;

a left mid-chest flap and a right mid-chest flap, and an enlarged abdominal flap located below the left mid-chest flap and the right mid-chest flap, and a central pocket flap between the left mid-chest flap and the right mid-chest flap, and a rear pocket flap, a tab extending upwardly on each flap facilitating opening and closing the flaps, each flap formed in an inverted U-shaped configuration with a lower horizontal section coupled to the gown, the gown having openings positioned respectively beneath the left mid-chest flap and the right mid-chest flap, and the abdominal flap, and the central pocket flap, and the rear pocket flap respectively, the pocket flaps adapted to removably receive telemetry and other devices in association with the providing medical care to the patient, fixed hook and loop fasteners in an inverted U-shaped configuration around each opening, separable hook and loop fasteners in an inverted U-shaped configuration around each flap adapted to couple and uncouple with respect to an associated fixed hook and loop fastener, the flaps adapted to be lowered providing for use by the care giver when administering to the patient; and a left passageway on the left side of the gown and a right passageway in the right side of the gown, each passageway being located beneath the abdominal flap for use by the care giver when administering to the patient.

7. A garment, comprising:

a medical gown comprising a front, a back, a left side, a right side, a left lateral arm opening and a right lateral arm opening;

an access opening in the gown, wherein the access opening provides access to a patient body part;

a flap covering the opening, the flap comprising:

a top flap section;

flap sides;

a lower flap section that is fixed to the gown, wherein a detachable portion of the flap is detachably coupled to the gown whereby detachably uncoupling the detachable portion of the flap reveals the access opening; and a pocket coupled to the flap wherein the flap comprises an abdominal flap; and wherein the garment further comprises a left passageway on the left side of the gown and a right passageway on the right side of the gown, each passageway being located beneath the abdominal flap.

8. The garment of claim 7, wherein the top flap section and the flap sides are detachably coupled to the gown.

9. The garment of claim 7, wherein the access opening in the gown comprises a plurality of access openings;

wherein the flap covering the opening comprises a plurality of flaps, each flap of the plurality flaps covers one access opening of the plurality of openings.

10. The garment of claim 9, wherein the pocket coupled to the flap comprises a plurality of pockets, each pocket of the plurality of pockets being coupled to one flap of the plurality of flaps.

* * * * *